US005346428A

United States Patent [19]

Robinson, Jr.

[11] Patent Number: 5,346,428

[45] Date of Patent: Sep. 13, 1994

[54] WALL MOUNTED FORCED AIR VENT HUMIDIFIER AND DRAFT CONTROL DEVICE

[76] Inventor: Carl R. Robinson, Jr., 16668 Mt. Hoffmane Cir., Fountain Valley, Calif. 92708

[21] Appl. No.: 2,637

[22] Filed: Jan. 11, 1993

[51] Int. Cl.[5] ..... F24F 6/02

[52] U.S. Cl. ..... 454/328

[58] Field of Search ..... 454/291, 328

[56] References Cited

U.S. PATENT DOCUMENTS 81,695 9/1868 Sinclair ..... 454/328

526,923 10/1894 Illiowizi ..... 454/328 X 2,997,938 8/1961 Sievert et al. ..... 454/328

4,240,991 12/1980 Shaub ..... 454/241

*Primary Examiner*—Harold Joyce

*Attorney, Agent, or Firm*—Dennis W. Beech

[57] ABSTRACT

A common wall mounted forced air duct register humidifier that has an easily replaced and maintained water bowl and includes a drum fan that has blades along its length to facilitate air movement to assure evaporation of the liquid placed in the bowl and an air deflection surface that partially deflects the air coming out of the forced air duct register into the water bowl to assure adequate evaporation.

6 Claims, 3 Drawing Sheets

WALL MOUNTED FORCED AIR VENT HUMIDIFIER AND DRAFT CONTROL DEVICE

FIELD OF THE INVENTION

The instant invention relates to an improved wall mounted humidifier that is attached to a forced air vent.

DESCRIPTION OF RELATED ART

Other devices similar to the wall mounted forced air vent humidifier and draft control device are difficult or unpractical to use. The prior arts cited in U.S. patents include Berardini (U.S. Pat. No. 4,654,198), Vesper (U.S. Pat. No. 4,226,174), Bohanon (U.S. Pat. No. 4,031,180), A. P. Sievert (U.S. Pat. No. 2,997,938), E. P. Dorsey (U.S. Pat. No. 2,960,022), C. A. Besch (U.S. Pat. No. 1,786,331), W. S. Spangle (U.S. Pat. No. 3,227,064), M. J. Kuss (U.S. Pat. No. 2,570,033) and Vesper (U.S. Pat. No. 4,307,656). These prior arts provide flexing by sophisticated controls of flexible surfaces. The prior art does not specifically address the application of the general user, affordability, cost to manufacturer or maintenance. The prior inventions do not provide an easily installed and reliable wall mounted forced air vent humidifying system with a minimum obstruction of the forced air movement utilizing a distributing means to assure adequate evaporation.

SUMMARY OF THE INVENTION

A primary objective of the improved wall mounted humidifier and draft control device is to introduce an increased level of humidity into a room and to stabilize the room temperature. The effect of the increase humidity is to reduce the fuel needed to heat the room to a comfortable level. The increased moisture reduces the damage common to household furnishings as well as some building materials that suffer undue deterioration as a result of an artificially induced low humidity. An even more stable level of heat distribution is also a result. The increase in humidity helps prevent the harsh drying of skin common with heated air conditioners. Properly serviced the device assists in trapping and removing from the air some of the heavier air pollutants. The air incident on the device is redirected to reduce the effect of drafts and also aids in stabilizing the room temperature.

In accordance with the description presented herein, other objectives of this invention will become apparent when the description and drawings are reviewed.

DESCRIPTION OF THE PREFERRED EMBODIMENT

Figure 1:
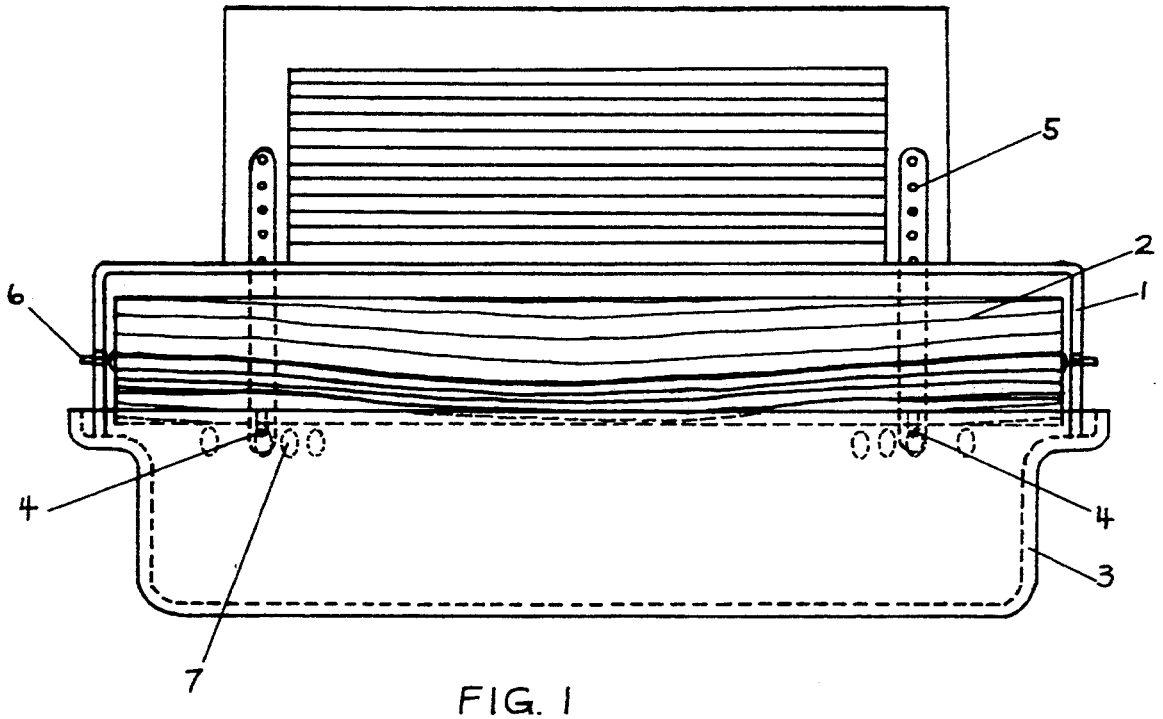
FIG. 1 illustrates the front view of the forced air vent humidifier and draft control embodying the features of the present invention.
Figure 2:
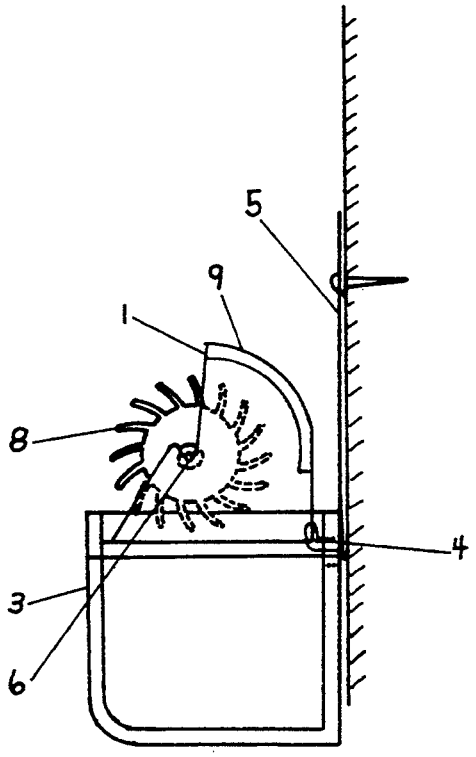
FIG. 2 illustrates the side view of the forced air vent humidifier and draft control.
Figure 3:
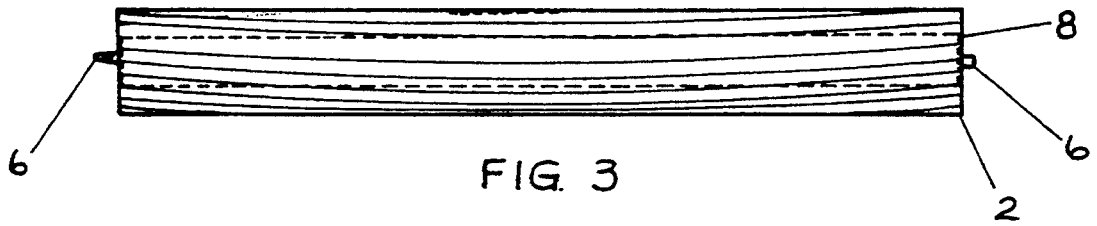
FIG. 3 illustrates the front view of the drum fan separated from the assembly.
Figure 4:
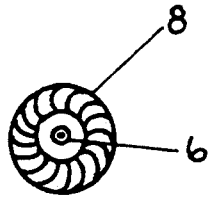
FIG. 4 illustrates the side view of the drum fan separated from the assembly.
Figure 5:
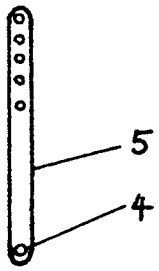
FIG. 5 illustrates the front view of the mounting bracket strap.
Figure 6:
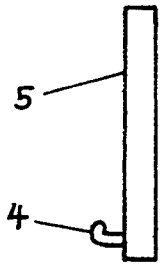
FIG. 6 illustrates a side view of the mounting bracket strap fan.
Figure 7:
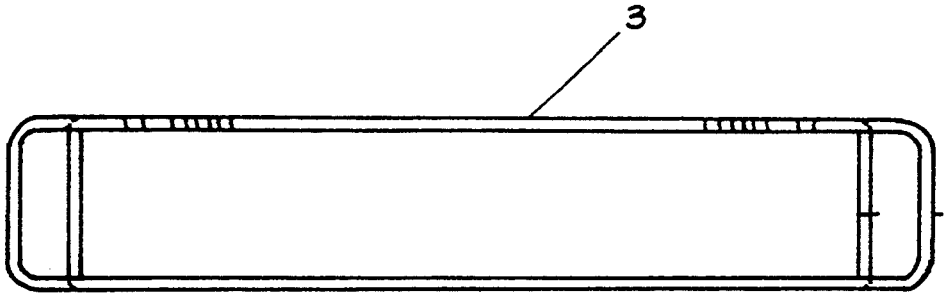
FIG. 7 illustrates a top view of the bowl.
Figure 8:
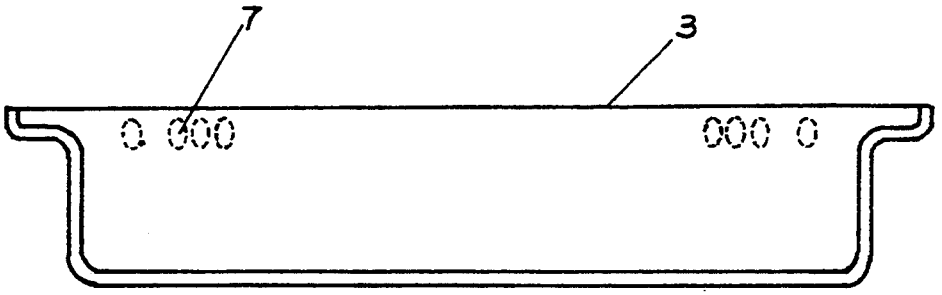
FIG. 8 illstrates a front view of the bowl.
Figure 10:
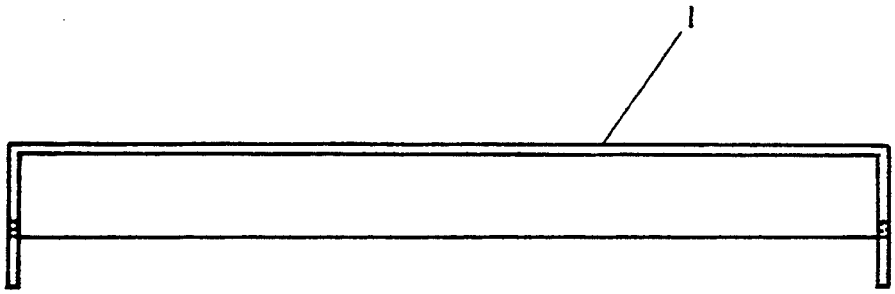
FIG. 10 illustrates a front view of the drum fan mounting and deflector.
Figure 9:
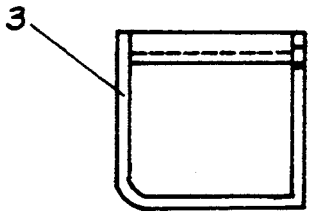
FIG. 9 illustrates a side view of the bowl.
Figure 11:
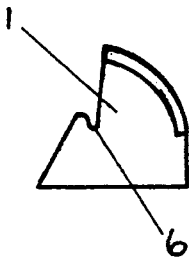
FIG. 11 illustrates a side view of the drum fan mounting bracket and deflector.

Referring to FIGS. 1 to 11, the improved forced air vent humidifier and draft control is shown. The device is comprised of seven separate parts, two mounting bracket straps (5) each having a mounting bracket hook (4), a bowl (3), a drum fan mount (1) and deflector (9) and a drum fan (2) . The mounting bracket strap (5) is constructed of a strong, lightweight material that is non-corrosive when exposed to moisture. Mounting bracket strap (5) of approximately four to six inches in length and approximately ½ inch in width have been shown to be sufficient. A mounting bracket hook (4) is placed on one end of each mounting bracket strap (5). The mounting bracket strap (5) has several vertically placed holes over approximately two thirds of the mounting straps length. The diameter of the holes is sufficient to allow the mounting screws used to attach register grills at the end of the air ducts to the walls to be used to attach the mounting bracket straps securely to each side of the register. The mounting bracket straps (5) are mounted vertically and do not intrude into the openings of the forced air register. The choice of which hole to be used for securing the mounting bracket strap (5) is be determined by the size of the register. In the final installation the top portion of the bowl (3) is positioned just below the lowest position of the openings in the register.

The bowl (3) is constructed of a transparent material such as glass. The bowl (3) is of sufficient strength to sustain is reasonable level of abuse without breaking. The bowl (3) constructed to withstand the cleaning action generated by an automatic dishwashing machine. The clarity of the bowl (3) is sufficient to view liquid placed inside through the outside wall of the bowl (3). Bowls (3) of approximately 20 inches in length, approximately 4½ inches in width and approximately 3 inches in depth have proven to be satisfactory.

The rear side of the length of the bowl (3) is flat and vertical. The shape of the rear side provides a flush mounting against the wall when installed just below the forced air register. Along the top edge of the rear side of the bowl (3) there are a series of vertical positioned oval openings (7). These openings allow the bowl (3) to be easily attached to the hooks (4) on the mounting bracket straps (5). The placement of these multiple holes accommodates the various widths of forced air register that are in common use. The oval openings (7) are placed along the length of the rear surface of the bowl (3) commencing approximately ¾ of an inch below the top edge of the bowl (3).

The ends of the bowl (3) are flared outward. A flaring of approximately ¾ of an inch outward from the more vertical surface has been shown to work well. The horizontal surface provides for the suspension of the drum fan mount (1) and deflector (9). The drum fan (2) is constructed of a non-corrosive material. The drum fan mount (1) and air deflector (9) material is sufficient strength to maintain rigidity when a drum fan (2) is mounted. At each end of the drum fan mount (1) and air deflector (9), the end is bent downward to form a leg that will rest on the flared inner ledges of the bowl (3). The ends of the drum fan mount (1) and air deflector (9)

are fashioned to incorporate a slotted cut out (6). The slotted cut out (6) accepts the axle (6) of the drum fan (2). The size of the slotted cut out (6) is sufficient to allow the axles of the drum fan (2) to cradle in the slotted cut out (10). A slightly curved section of the drum fan mount (1) and air deflector (9) extends the width of the bowl (3) and serves as a partial windshield. The deflector (9) bottom edge is parallel and slightly below the point of the drum axle when the drum fan (2) is installed. The upper edge of the drum fan mount (1) and air deflector (9) extends slightly above the upper blades of the drum fan (2). The shape of the curve of the deflector (9) maintains an equal distance from the outer edges of the drum fan (2) blades. The drum fan mount (1) and air deflector (9) surface shields the upper half of the drum fan (2) from air expelled from the air duct register. The arrangement of drum fan mount (1) and air deflector (9) and drum fan (2) promotes the spin of the drum fan (2).

The drum fan (2) is in the form of a cylinder. The drum fan (2) width extends the length of the lower area of bowl (3). Axles at each end of the drum fan (2) extends out from the ends and rest on the slotted cut outs (10) of the drum fan mount (1) and air deflector (9). Crescent shaped blades (8) along the length of the cylinder of the drum fan (2) extend outward at an angle from the cylinder. The shape and angle of the crescent shaped blades (8) are sufficient to cause a spinning motion of the drum fan (2) when acted upon by air being expelled from the forced air duct register. In the preferred embodiment, the shape and angle of the crescent shaped blades includes a curvature along the blades (8) length to further redirect the incident air to control the draft pattern within the room. The spinning motion of the drum fan (2) in cooperation with the shaped crescent shaped blades (8) increases the air circulation over the surface of the liquid placed in the bowl (2) and substantially increase the evaporation of the liquid.

I claim:

1. An improved forced air vent humidifier and draft control adapted to be positioned in an air stream being expelled for a register comprising:

a. a bowl having an open surface at the top and an attachment means to attach the bowl;

b. a mounting bracket that attaches to a wall and that accepts the attachment means of the bowl;

c. a cylindrical drum fan with axles protruding beyond the ends of the drum;

d. a drum fan mounting means that accepts the drum fan axles and suspends the drum fan over the bowl; and e. a curved deflector having the concave side facing the drum fan, the bottom edge of the deflector being positioned substantially at the vertical level of the drum fan axles whereby only the upper half of the drum fan is shielded from the air expelled form the register.

2. An improved forced air vent humidifier and draft control as in claim 1 wherein the attachments means to attached the bowl to the mounting bracket comprising of a hook and opening working in cooperation.

3. An improved forced air vent humidifier and draft control as in claim 1 wherein the drum fan mounting comprises two parallel surface at each end of the bowl that rests on the bowl and each has a slotted surface to accept the axles of the drum fan.

4. An improved forced air vent humidifier and draft control as in claim 1 wherein the drum fan has crescent shaped fan blades along the length of the drum fan.

5. An improved forced air vent humidifier and draft control as in claim 1 wherein the drum fan mounting means is integrally part of the deflector.

6. An improved forced air vent humidifier and draft control as in claim 1 wherein the drum fan has shaped fan blades that are curved along the length of the fan drum.

* * * * *